US009470994B2

(12) United States Patent
Yoshihara et al.

(10) Patent No.: US 9,470,994 B2
(45) Date of Patent: Oct. 18, 2016

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Kotaro Yoshihara, Kanagawa (JP); Noriyuki Mizutani, Kanagawa (JP); Tomoaki Tanaka, Kanagawa (JP); Eisuke Iwazaki, Kanagawa (JP); Asafumi Fujita, Kanagawa (JP); Narumasa Sato, Kanagawa (JP); Erina Saito, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/624,711

(22) Filed: Feb. 18, 2015

(65) Prior Publication Data

US 2016/0085167 A1 Mar. 24, 2016

(30) Foreign Application Priority Data

Sep. 19, 2014 (JP) ..... 2014-191950

(51) Int. Cl.
*G03G 9/093* (2006.01)
*G03G 9/087* (2006.01)
*G03G 9/08* (2006.01)

(52) U.S. Cl.
CPC ..... *G03G 9/08733* (2013.01); *G03G 9/08* (2013.01); *G03G 9/0819* (2013.01); *G03G 9/0825* (2013.01)

(58) Field of Classification Search
CPC ..... G03G 9/097; G03G 9/08708; G03G 9/08755; G03G 9/08782; G03G 9/09307
See application file for complete search history.

(56) References Cited

U.S. PATENT DOCUMENTS

| | | | | |
|---|---|---|---|---|
| 9,110,392 | B2 | 8/2015 | Fukuri | |
| 9,280,076 | B1 | 3/2016 | Li et al. | |
| 9,304,423 | B2 * | 4/2016 | Iwazaki | G03G 9/08711 |
| 2007/0166635 | A1 | 7/2007 | Yamamoto et al. | |
| 2008/0096119 | A1 * | 4/2008 | Yamamoto | G03G 9/0804 430/109.4 |
| 2008/0124635 | A1 * | 5/2008 | Nakamura | G03G 9/0819 430/48 |
| 2008/0138733 | A1 | 6/2008 | Ueda et al. | |
| 2008/0160442 | A1 | 7/2008 | Kim et al. | |
| 2008/0166156 | A1 | 7/2008 | Kawase | |
| 2009/0098475 | A1 | 4/2009 | Yamada et al. | |
| 2009/0297225 | A1 | 12/2009 | Yamada et al. | |
| 2012/0040285 | A1 * | 2/2012 | Shibata | G03G 9/09328 430/110.2 |
| 2012/0219321 | A1 | 8/2012 | Fukao et al. | |
| 2014/0127620 | A1 * | 5/2014 | Bayley | G03G 9/09321 430/108.2 |
| 2014/0134532 | A1 * | 5/2014 | Sumioka | G03G 9/09371 430/109.4 |
| 2015/0118610 | A1 * | 4/2015 | Nosella | G03G 9/09392 430/108.3 |
| 2015/0118613 | A1 * | 4/2015 | Nosella | G03G 9/08711 430/109.3 |
| 2016/0085168 | A1 * | 3/2016 | Iwazaki | G03G 9/08755 430/105 |

FOREIGN PATENT DOCUMENTS

| | | | |
|---|---|---|---|
| JP | 2004-109485 | A | 4/2004 |
| JP | 2007-192952 | A | 8/2007 |
| JP | 2008-145568 | A | 6/2008 |
| JP | 2011-123483 | A | 6/2011 |
| JP | 2012-255957 | A | 12/2012 |
| JP | 2013-130824 | A | 7/2013 |
| JP | 2013-142877 | A | 7/2013 |
| JP | 2013-254123 | A | 12/2013 |

OTHER PUBLICATIONS

May 31, 2016 Office Action Issued in U.S. Appl. No. 14/617,316.
Jun. 20, 2016 Notice of Allowance issued in U.S. Appl. No. 14/807,525.
U.S. Appl. No. 14/807,525, filed Jul. 23, 2015 in the name of Yoshida et al.
U.S. Appl. No. 14/617,316, filed Feb. 9, 2015 in the name of Tanaka et al.

* cited by examiner

*Primary Examiner* — Hoa V Le
(74) *Attorney, Agent, or Firm* — Oliff PLC

(57) ABSTRACT

An electrostatic charge image developing toner includes toner particles containing a binder resin including a polyester resin, a release agent including a hydrocarbon wax, and a styrene (meth)acrylic resin, wherein 70% or more of the release agent with respect to the entire release agent is present within 800 nm from the surface of the toner particles, wherein the styrene (meth)acrylic resin forms domains having an average diameter of 0.3 μm to 0.8 μm in the toner particles, and wherein a number ratio of the domains included in a range of the average diameter±0.1 μm is less than 65%.

24 Claims, 2 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2014-191950 filed Sep. 19, 2014.

BACKGROUND

1. Technical Field

The present invention relates to an electrostatic charge image developing toner, an electrostatic charge image developer, and a toner cartridge.

2. Related Art

Methods for visualizing image information via an electrostatic charge image by an electrophotographic process or the like are currently utilized in various fields. In the electrophotographic method, the image is visualized through charging and exposure steps of forming image information as an electrostatic charge image on the surface of an image holding member (photoreceptor); a step of developing a toner image on the surface of the photoreceptor using a developer including a toner; a transfer step of transferring the toner image onto a recording medium such as paper; and a fixing step of fixing the toner image onto the surface of a recording medium.

SUMMARY

According to an aspect of the invention, there is provided an electrostatic charge image developing toner including:

toner particles containing a binder resin including a polyester resin, a release agent including a hydrocarbon wax, and a styrene (meth)acrylic resin, wherein 70% or more of the release agent with respect to the entire release agent is present within 800 nm from the surface of the toner particles;

wherein the styrene (meth)acrylic resin forms domains having an average diameter of 0.3 μm to 0.8 μm in the toner particles; and wherein a number ratio of the domains included in a range of the average diameter±0.1 μm is less than 65%.

BRIEF DESCRIPTION OF THE DRAWINGS

Exemplary embodiments of the present invention will be described in detail, based on the following figures, wherein.

DETAILED DESCRIPTION

Figure 1:
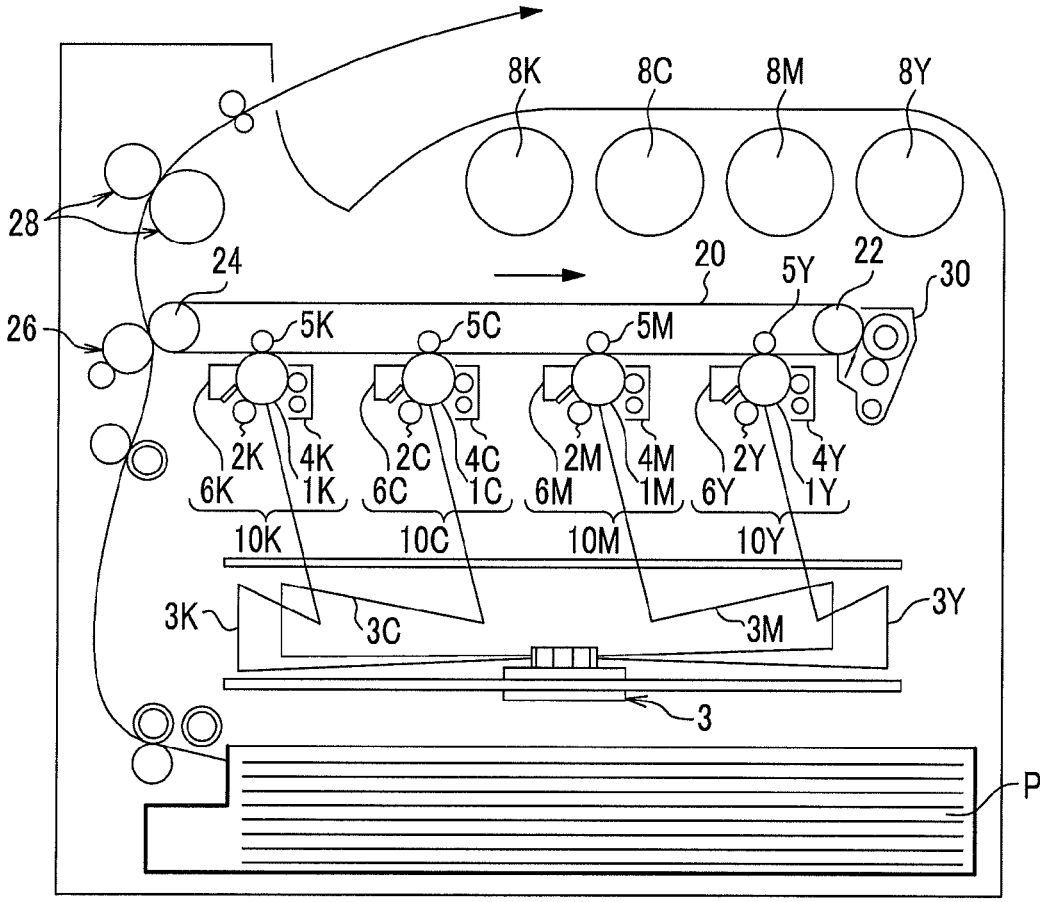
FIG. 1 is a schematic configuration diagram showing an example of an image forming apparatus according to the present exemplary embodiment.

Hereinafter, the present exemplary embodiments of the invention will be described. Such descriptions and Examples are only illustrative of the invention and are not intended to limit the scope of the invention.

Electrostatic Charge Image Developing Toner

An electrostatic charge image developing toner according to the present exemplary embodiment (hereinafter referred to as a "toner") includes toner particles containing a binder resin including a polyester resin, a release agent including a hydrocarbon wax, and a styrene (meth)acrylic resin.

Furthermore, in the toner particles, 70% or more of the entire release agent is present within 800 nm from the surface of the toner particles, the styrene (meth)acrylic resin form domains having an average diameter of 0.3 μm to 0.8 μm in the toner particles, and further, the number ratio of the domains included in the range of the average diameter±0.1 μm is less than 65%.

Formation of domains with the styrene (meth)acrylic resin in the toner particles means a state where a sea-island structure in which the binder resin corresponds to a sea portion and the styrene (meth)acrylic resin corresponds to an island portion, is formed. That is, the domain of the styrene (meth)acrylic resin is an island portion of the sea-island structure.

It is presumed that by the configuration above, the toner according to the present exemplary embodiment prevents offset occurring when writing is conducted on paper overlapping the image. The reason for this is not clear, but is presumed to be as follows.

In the related art, a toner including a polyester resin as a binder resin has been known. The polyester resin is a resin having a relatively low glass transition temperature, and thus, is preferable to ensure fixability at a low temperature of a toner. However, the polyester resin which is a resin having a relatively low glass transition temperature is present on the surface of the toner, and therefore, the toner tends to have reduced fluidity and preservability.

In contrast, a technique in which a styrene (meth)acrylic resin is used in combination with a polyester resin for the purpose of improving the fluidity and preservability of the toner is known. However, when writing is conducted on paper overlapping over the image formed with a toner including a polyester resin and a styrene (meth)acrylic resin, the image is migrated to the back of the paper to cause the missing of an image in some cases. This phenomenon easily occurs in the case where printing is continuously carried out in a state in which an image forming apparatus is not sufficiently warmed up (for example, immediately after the power of the image forming apparatus is turned on), in the case where printing is carried out on rough paper having a rough surface, or in the case where a toner image is fixed with a low-temperature and low-pressure fixing device.

The missing of an image hardly occurs even when writing is directly conducted on an image causing the phenomenon, and therefore, it is thought that the image intensity (due to adhesion between the toners) is sufficient. The phenomenon is a transition of the image to the paper surface facing the image, and from the viewpoint that the phenomenon easily occurs particularly under a low-temperature and low-pressure fixing condition, it is thought that the cause of the phenomenon is from a decrease in penetration property of the toner into a recording medium at a time of fixing the toner image. As a mechanism, from the viewpoint that the compatibility between the polyester resin and the styrene (meth)acrylic resin is low, it is thought that the toner viscosity at the time of fixing increases, the penetration property of the toner into a recording medium is reduced, and the adhesion between the fixed image and the paper is decreased. Further, it is thought that irregularities are easily generated on the surface of an image by the low compatibility between the polyester resin and the styrene (meth) acrylic resin, which promote the offset of the image.

In the present exemplary embodiment for the phenomenon above, the toner particles contain a release agent including a hydrocarbon wax, and 70% or more of the entire release agent is present within 800 nm from the surface of the toner particles (hereinafter the presence ratio of the release agent present within 800 nm from the surface of the toner particles is referred to as an "presence ratio of the release agent").

Among waxes, a hydrocarbon wax has relatively high compatibility with a styrene (meth)acrylic resin, and thus, it acts as a plasticizer for the styrene (meth)acrylic resin and improves the penetration properties of the resin into the paper. Further, the hydrocarbon wax has a chemical structure different from that of a polyester resin, as compared with an ester wax, such that the affinity is lower and the bleeding from the toner particles easily occurs.

In addition, the presence ratio of the release agent is 70% or more, that is, the release agent is abundantly present in the vicinity of the toner surface layer, and therefore, the bleeding of the release agent from the toner particles easily occurs and the original function of the release agent is easily exhibited.

From the viewpoint above, the presence ratio of the release agent is 70% or more, and preferably 80% or more. The upper limit of the presence ratio of the release agent is preferably 100%.

Furthermore, in the present exemplary embodiment for the phenomenon above, the average diameter of the domains of the styrene (meth)acrylic resin is from 0.3 μm to 0.8 μm. The domain size gives an influence on the viscoelasticity at a time when the toner is melted, and the size needs to be adjusted to a suitable domain size. If the average diameter of the domains is less than 0.3 μm, the total surface area of the domains increases, and therefore, the action of the hydrocarbon wax hardly spreads wide, furthermore, the number of the domains increases, and thus, the viscoelasticity is likely to increase. As a result, when the toner is melted, it easily gets thickened and the toner penetration properties are reduced. On the other hand, if the average diameter of the domains is more than 0.8 μm, the irregularities on the surface of the image increase and the offset of the image is easily promoted.

From this viewpoint, the average diameter of the domains is from 0.3 μm to 0.8 μm, and more preferably from 0.3 μm to 0.6 μm.

Further, for the phenomenon above, the present exemplary embodiment is related to the domains of the styrene (meth)acrylic resin, and the number ratio of the domains included within a range of the average diameter±0.1 μm is less than 65%. That is, the distribution of the domain sizes is extended to a certain degrees. If the domain sizes are uniformly arranged, the thickening easily occurs when the toner is melted, and as a result, the distribution of the domain sizes is widened and thus, the thickening is prevented when the toner is melted.

From this viewpoint, the number ratio of the domains included within a range of the average diameter±0.1 μm is less than 65%, and preferably less than 55%, provided that since it is necessary to set an appropriate domain surface area from the viewpoint of the styrene (meth)acrylic resin action of the hydrocarbon wax, the ratio is preferably 35% or more.

In the present exemplary embodiment, the number ratio of the domains included within a range of the average diameter±0.2 μm in the domains of the styrene (meth)acrylic resin is preferably 80% or more. If the distribution of the domain size is within the above range, the smoothness of the image surface is superior, the offset of the image is further prevented, the adhesion between the toners is improved, and the image intensity is further enhanced.

From the viewpoint, the number ratio of the domains included within a range of the average diameter±0.2 μm is preferably 80% or more, and more preferably 90% or more, provided that the ratio is preferably less than 95% from the viewpoint that the domain sizes are not too uniform.

By a synergic effect of the effect of the release agent including a hydrocarbon wax and the presence ratios thereof as described above, and the effect of the domain size of the styrene (meth)acrylic resin and a distribution thereof, the toner according to the present exemplary embodiment has excellent penetration properties to paper during the fixing, and the irregularities on the surface of an image are prevented, and as a result, the offset occurring when writing is conducted on paper overlapping over the image is prevented.

Hereinbelow, the methods for measuring the presence ratio of the release agents, and the average diameter of the domains of the styrene (meth)acrylic resin will be described.

The samples and images for measurement will be prepared by the following method.

A toner is mixed and embedded in an epoxy resin, and then the epoxy resin is solidified. The solidified product thus obtained is cut out by an Ultramicrotome device (ULTRACUT UCT manufactured by Leica) to prepare a thin sample having a thickness of 80 nm to 130 nm. Next, the thin sample thus obtained is dyed for 3 hours with ruthenium tetraoxide in a desiccator at 30° C. Further, an SEM image of the dyed thin sample is obtained using an Ultra High Resolution Field Emission Scanning Electron Microscope (FE-SEM, S-4800 manufactured by Hitachi High-Technologies Corporation). Since the release agent, the styrene (meth)acrylic resin, and the polyester resin are easily dyed with ruthenium tetraoxide in this order, the respective components are identified according to the shade by the extent of the dying. In the case where the shade is not easily evaluated by the state of a sample, or the like, the dying time is adjusted.

Further, in the cross-section of the toner particle, the domain of the colorant is smaller than the domain of the release agent and the domain of the styrene (meth)acrylic resin, and thus, identification may be conducted by the size.

The presence ratio of the release agents is a value measured by the following method.

In the SEM image, the cross-sections of the toner particles each having a maximum length of 85% or more of the volume average particle diameter of the toner particles are selected and the domains of the dyed release agent is observed. Further, the area of the release agents of the entire toner particles and the area of the release agents present in the region within 800 nm from the surface of the toner particles are determined, and thus, a ratio of both the areas (the area of the release agents present in the region within 800 nm from the surface of the toner particles/the area of the release agents of the entire toner particles) is calculated. In addition, this calculation is carried out for 100 toner particles and an average value thereof is taken as the presence ratio of the release agents.

The reason why the cross-sections of the toner particles each having a maximum length of 85% or more of the volume average particle diameter of the toner particles are selected is that the cross-section having a volume average particle diameter of less than 85% is expected to be the cross-section of the end portions of the toner particle, and thus, the cross-section of the end portions of the toner particle does not reflect the state of the domains in the toner particles well.

The average diameter of the domain of the styrene (meth) acrylic resin is a value measured by the following method.

In the SEM image, 30 cross sections of the toner particle having a maximum length which is 85% or more of a volume average particle diameter of the toner particle are selected, and total 100 domains of the dyed styrene (meth) acrylic resins are observed. The maximum length of each domain is measured, the maximum length is assumed as a diameter of the domain, and the arithmetic average is set as the average diameter.

In addition, with the measured diameters of total 100 domains, the number ratio of the domains having a diameter in a range of the average diameter±0.1 μm, and the number ratio of the domains having a diameter in a range of the average diameter±0.2 μm are determined.

As a method of controlling the presence ratio of the release agent to be equal to or greater than 70%, a method of setting the toner particle with a core/shell structure and using the release agent when forming a shell is used, for example.

The average diameter of the domain of the styrene (meth) acrylic resin and the distribution of the domain size are controlled by a method of preparing the toner particle by aggregation and coalescence and adjusting a volume average particle diameter of resin particles contained in a styrene (meth)acrylic resin particle dispersion used at the time of the preparing; a method of preparing plural styrene (meth) acrylic resin particle dispersions having different volume average particle diameters and using the combination thereof; or the like, for example.

Hereinafter, the toner according to the exemplary embodiment will be described in detail.

The toner according to the exemplary embodiment includes the toner particles. The toner may include an external additive which is externally added to the toner particle.

Toner Particle

The toner particle includes a binder resin, a release agent containing hydrocarbon wax, and a styrene (meth)acrylic resin. The toner particle may contain other internal additives such as a colorant.

The toner particle, for example, includes a sea-island structure in which the release agent and the styrene (meth) acrylic resin are dispersed in the binder resin.

Binder Resin

As the binder resin, a polyester resin is used in a viewpoint of fixability. A rate of the polyester resin with respect to the entire binder resin is equal to or greater than 85% by weight, preferably equal to or greater than 95% by weight, and more preferably 100% by weight, for example.

As the polyester resin, a well-known polyester resin is used, for example.

Examples of the polyester resin include polycondensates of polyvalent carboxylic acids and polyols. A commercially available product or a synthediameterd product may be used as the polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acids, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adducts of bisphenol A and propylene oxide adducts of bisphenol A). Among these, for example, aromatic diols and alicyclic diols are preferably used, and aromatic diols are more preferably used as the polyol.

As the polyol, a tri- or higher-valent alcohol employing a crosslinked structure or a branched structure may be used in combination with a diol. Examples of the tri- or higher-valent polyol include glycerin, trimethylolpropane, and pentaerythritol.

The polyols may be used alone or in combination of two or more kinds thereof.

The glass transition temperature (Tg) of the polyester resin is preferably from 50° C. to 80° C., and more preferably from 50° C. to 65° C.

The glass transition temperature is determined by a DSC curve obtained by differential scanning calorimetry (DSC). More specifically, the glass transition temperature is determined by "extrapolating glass transition starting temperature" disclosed in a method of determining the glass transition temperature of JIS K7121-1987 "Testing Methods for Transition Temperatures of Plastics".

A weight average molecular weight (Mw) of the polyester resin is preferably from 5,000 to 1,000,000, and more preferably from 7,000 to 500,000.

A number average molecular weight (Mn) of the polyester resin is preferably from 2,000 to 100,000.

A molecular weight distribution Mw/Mn of the polyester resin is preferably from 1.5 to 100, and more preferably from 2 to 60.

The weight average molecular weight and the number average molecular weight of the resin are measured by gel permeation chromatography (GPC). The molecular weight measurement by GPC is performed with tetrahydrofuran as a solvent, using a HLC-8120 manufactured by Tosoh Corporation as a measurement device and a TSKgel Super HM-M (15 cm) manufactured by Tosoh Corporation as a column. The weight average molecular weight and the number average molecular weight are calculated from results of this measurement using a calibration curve of molecular weights created with monodisperse polystyrene standard samples.

The polyester resin is obtained with a well-known preparing method. Specific examples thereof include a method of conducting a reaction at a polymerization temperature set to 180° C. to 230° C., if necessary, under reduced pressure in the reaction system, while removing water or alcohol generated during condensation.

When monomers of the raw materials do not dissolve or become compatibilized at a reaction temperature, a highboiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with a major component.

The content of the binder resin is, for example, preferably from 40% by weight to 95% by weight, more preferably from 50% by weight to 90% by weight, and even more preferably from 60% by weight to 85% by weight, with respect to the entire toner particles.

As the binder resin, other binder resin may be used with the polyester resin.

Examples of the other binder resin include a vinyl resin formed of a homopolymer including monomers such as styrenes (for example, styrene, p-chlorostyrene, α-methyl styrene, or the like), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, or the like), ethylenic unsaturated nitriles (for example, acrylonitrile, methacrylonitrile, or the like), vinyl ethers (for example, vinyl methyl ether, vinyl isobutyl ether, or the like), vinyl ketones (for example, vinyl methyl ketone, vinyl ethyl ketone, vinyl isopropenyl ketone, or the like), olefins (for example, ethylene, propylene, butadiene, or the like), or a copolymer obtained by combining two or more kinds of these monomers (herein, excluding the styrene (meth)acrylic resin).

Examples of the other binder resin include a non-vinyl resin such as an epoxy resin, a polyester resin, a polyurethane resin, a polyamide resin, a cellulose resin, a polyether resin, and a modified rosin, a mixture of these and a vinyl resin, or a graft polymer obtained by polymerizing a vinyl monomer in the presence thereof.

These other binder resins may be used alone or in combination with two or more kinds thereof.

Styrene (Meth)Acrylic Resin

The styrene (meth)acrylic resin is a copolymer obtained by at least copolymerizing a monomer having a styrene structure and a monomer having a (meth)acrylic acid structure. "(Meth)acryl" is an expression including both of "acrylic acid" and "methacrylic acid".

Examples of the monomer having a styrene structure (hereinafter, referred to as a "styrene monomer") include styrene, alkyl substituted styrene (for example, α-methyl styrene, 2-methyl styrene, 3-methyl styrene, 4-methyl styrene, 2-ethyl styrene, 3-ethyl styrene, or 4-ethyl styrene), halogen substituted styrene (for example, 2-chlorostyrene, 3-chlorostyrene, or 4-chlorostyrene), and vinyl naphthalene. The styrene monomer may be used alone or in combination of two or more kinds thereof.

Among these, styrene is preferable as the styrene monomer, in viewpoints of ease of reaction, ease of controlling of the reaction, and availability.

Examples of the monomer having a (meth)acrylic acid structure (hereinafter, referred to as a "(meth)acrylic monomer") include (meth)acrylic acid and (meth)acrylic acid ester. Examples of (meth)acrylic acid ester include (meth) acrylic acid alkyl ester (for example, n-methyl (meth)acrylate, n-ethyl (meth)acrylate, n-propyl (meth)acrylate, n-butyl (meth)acrylate, n-pentyl (meth)acrylate, n-hexyl (meth) acrylate, n-heptyl (meth)acrylate, n-octyl (meth)acrylate, n-decyl (meth)acrylate, n-dodecyl (meth)acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth)acrylate, t-butyl (meth)acrylate, isopentyl (meth)acrylate, amyl (meth)acrylate, neopentyl (meth)acrylate, isohexyl (meth)acrylate, isoheptyl (meth) acrylate, isooctyl (meth)acrylate, 2-ethylhexyl (meth) acrylate, cyclohexyl (meth)acrylate, or t-butylcyclohexyl (meth)acrylate), (meth)acrylic acid aryl ester (for example, phenyl (meth)acrylate, biphenyl (meth)acrylate, diphenylethyl (meth)acrylate, t-butylphenyl (meth)acrylate, or terphenyl (meth)acrylate), dimethylaminoethyl (meth)acrylate, diethylaminoethyl (meth)acrylate, methoxyethyl (meth) acrylate, 2-hydroxyethyl (meth)acrylate, β-carboxyethyl (meth)acrylate, and (meth)acrylamide. The (meth)acrylic acid monomer may be used alone or in combination of two or more kinds thereof.

A copolymerization ratio of the styrene monomer and the (meth)acrylic monomer (styrene monomer/(meth)acrylic monomer based on weight) is, preferably from 85/15 to 70/30, for example.

The styrene (meth)acrylic resin preferably has a crosslinked structure, in order to prevent cracks on the toner particle. As the styrene (meth)acrylic resin having a crosslinked structure, a crosslinked material obtained by copolymerizing and crosslinking at least the monomer having a styrene structure, the monomer having a (meth)acrylic acid structure, and a crosslinking monomer, for example.

Examples of the crosslinking monomer include a bi- or higher functional crosslinking agent.

Examples of the bifunctional crosslinking agent include divinyl benzene, divinyl naphthalene, a di(meth)acrylate compound (for example, diethylene glycol di(meth)acrylate, methylenebis(meth)acrylamide, decanediol diacrylate, or glycidyl (meth)acrylate), polyester type di(meth)acrylate, and 2-([1'-methylpropylidene amino]carboxyamino)ethyl methacrylate.

Examples of multifunctional crosslinking agent include a tri(meth)acrylate compound (for example, pentaerythritol tri(meth)acrylate, trimethylolethane tri(meth)acrylate, or trimethylolpropane tri(meth)acrylate), a tetra(meth)acrylate compound (for example, tetramethylolmethane tetra(meth) acrylate, or oligoester (meth)acrylate), 2,2-bis(4-methacryloxy, polyethoxy phenyl) propane, diallyl phthalate, triallyl cyanurate, triallyl asocyanurate, triallyl isocyanurate, triallyl trimellitate, and diaryl chlorendate.

A copolymerization ratio of the crosslinking monomer with respect to the entirety of monomers (crosslinking monomer/entirety of monomer based on weight) is, preferably from 2/1000 to 30/1000, for example.

Preferably, the weight average molecular weight of the styrene (meth)acrylic resin is, for example, from 30000 to 200000, preferably from 40000 to 100000, and more preferably from 50000 to 80000, from the viewpoint of prevention of the offset of an image.

The weight average molecular weight of the styrene (meth)acrylic resin is a value measured by the same method as that for the weight average molecular weight of the polyester resin.

Preferably, the content of the styrene (meth)acrylic resin is, for example, from 10% by weight to 30% by weight, preferably from 12% by weight to 28% by weight, and more preferably from 15% by weight to 25% by weight, with respect to that of the toner particles, from the viewpoint of satisfying both of the fluidity and preservability of a toner, and prevention of the offset of an image.

Release Agent

As a release agent, at least a hydrocarbon wax is applied. The ratio of the hydrocarbon wax to the entire release agent is preferably at least 85% by weight or more, more preferably from 95% by weight or more, and even more preferably 100% by weight.

The hydrocarbon wax is a wax having a hydrocarbon as a structure, and examples thereof include a Fischer-Tropsch wax, a polyethylene wax (a wax having a polyethylene structure), a polypropylene wax (a wax having a polypropylene structure), a paraffin wax (a wax having a paraffin structure), and a microcrystalline wax. Among these, as the hydrocarbon wax, the Fischer Tropsch wax is preferable from the viewpoints of prevention of the irregularities in the gloss of a half tone image; and the polyethylene wax or the polypropylene wax is preferable from the viewpoints of prevention of the offset of an image. Further, plural hydrocarbon waxes are preferably included in the toner particle from the viewpoint of an excellent effect of prevention of the offset of an image.

The melting temperature of the release agent is, for example, preferably from 85° C. to 110° C., and more preferably from 90° C. to 105° C., from the viewpoint of prevention of the offset of an image.

The melting temperature of the release agent is determined from a differential scanning calorimetry (DSC) curve by DSC, using the "melting peak temperature" described in the method of determining a melting temperature in the "Testing Methods for Transition Temperatures of Plastics" in JIS K7121-1987.

The content of the release agent is, for example, preferably from 1% by weight to 20% by weight, more preferably from 3% by weight to 20% by weight, still more preferably from 3% by weight to 15% by weight, and even still more preferably from 5% by weight to 15% by weight, with respect to the entire toner particles.

Colorant

Examples of the colorant include pigments such as carbon black, chrome yellow, Hansa yellow, benzidine yellow, thuren yellow, quinoline yellow, pigment yellow, permanent orange GTR, pyrazolone orange, Balkan orange, watchung red, permanent red, brilliant carmin 3B, brilliant carmin 6B, DuPont oil red, pyrazolone red, lithol red, Rhodamine B Lake, Lake Red C, pigment red, rose bengal, aniline blue, ultramarine blue, chalco oil blue, methylene blue chloride, phthalocyanine blue, pigment blue, phthalocyanine green, and malachite green oxalate; and dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes. The colorants may be used singly or in combination of two or more kinds thereof.

If necessary, a surface-treated colorant may be used, and the colorant may be used in combination with a dispersant.

The content of the colorant is, for example, preferably from 1% by weight to 30% by weight, and more preferably from 3% by weight to 15% by weight, with respect to the entire toner particles.

Other Additives

Examples of other additives include known additives such as a magnetic material, a charge-controlling agent, and an inorganic powder. These additives may be included as internal additives in the toner particles.

Characteristics of Toner Particles

The toner particles may be toner particles having a single layer structure, or toner particles having a so-called core-shell structure composed of a core (core particle) and a coating layer (shell layer) that is coated on the core, with the core-shell structure being preferable. The toner particles having a core-shell structure may preferably be composed of, for example, a core configured to include a binder resin, a styrene (meth)acrylic resin, and a colorant, and a coating layer configured to include a binder resin and a release agent.

The volume average particle diameter (D50*v*) of the toner particles is preferably from 2 μm to 10 μm, and more preferably from 4 μm to 8 μm.

Various average particle diameters and various particle size distribution indices of the toner particles are measured using a Coulter Multisizer II (manufactured by Beckman Coulter, Inc.) with ISOTON-II (manufactured by Beckman Coulter, Inc.) as an electrolyte.

In the measurement, from 0.5 mg to 50 mg of a measurement sample is added to 2 ml of an aqueous solution of 5% by weight of surfactant (preferably sodium alkylbenzene sulfonate) as a dispersant. The obtained material is added to from 100 ml to 150 ml of an electrolyte.

The electrolyte in which the sample is suspended is subjected to a dispersion treatment using an ultrasonic disperser for 1 minute, and a particle size distribution of particles having a particle diameter of from 2 μm to 60 μm is measured by a Coulter Multisizer II using an aperture having an aperture diameter of 100 μm. 50000 particles are sampled.

Cumulative distributions by volume and by number are drawn from the side of the smallest diameter on the basis of particle size ranges (channels) separated, based on the measured particle size distribution. The particle diameter when the cumulative percentage becomes 16% is defined as that corresponding to a volume particle diameter D16*v* and a number particle diameter D16*p*, while the particle diameter when the cumulative percentage becomes 50% is defined as that corresponding to a volume average particle diameter D50*v* and a number average particle diameter D50*p*. Further, the particle diameter when the cumulative percentage becomes 84% is defined as that corresponding to a volume particle diameter D84*v* and a number particle diameter D84*p*.

Using these, a volume average particle size distribution index (GSDv) is calculated as $(D84v/D16v)^{1/2}$ and a number average particle size distribution index (GSDp) is calculated as $(D84p/D16p)^{1/2}$.

A shape factor SF1 of the toner particles is preferably from 110 to 150, and more preferably from 120 to 140.

The shape factor SF1 is determined by the following equation:

$$SF1=(ML^2/A)\times(\pi/4)\times 100 \quad \text{Equation}$$

In the equation, ML represents an absolute maximum length of a toner particle and A represents a projected area of a toner particle.

Specifically, the shape factor SF1 is digitalized mainly using a microscopic image or an image of a scanning electron microscope (SEM) that is analyzed using an image analyzer and calculated as follows. That is, an optical microscopic image of particles sprayed on the surface of a glass slide is scanned into an image analyzer LUZEX through a video camera, the maximum lengths and the projected areas of 100 particles are obtained for calculation using the above-described equation, and an average value thereof is obtained.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O—(TiO_2)_n$, $Al_2O_3.2SiO_2$, $CaCO_3$, $MgCO_3$, $BaSO_4$, and $MgSO_4$.

It is preferable that the surfaces of the inorganic particles as the external additive are subjected to a hydrophobization treatment. For example, the hydrophobization treatment is performed, by dipping the inorganic particles in a hydrophobizing agent. The hydrophobizing agent is not particularly limited and examples thereof include a silane coupling agent, silicone oil, a titanate coupling agent and an aluminum coupling agent. These may be used singly or in combination of two or more kinds thereof.

For example, the amount of the hydrophobizing agent is from 1 part by weight to 10 parts by weight with respect to 100 parts by weight of the inorganic particles.

Examples of the external additives also include resin particles (resin particles such as polystyrene, PMMA, and a melamine resin) and cleaning activators (for example, a metal salt of higher fatty acid represented by zinc stearate and a particle of a fluorine polymer).

The amount of the external additive externally added is, for example, preferably from 0.01% by weight to 5% by weight, and more preferably from 0.01% by weight to 2% by weight, with respect to the toner particles.

Preparing Method of Toner

The toner particles are prepared and the toner particles may be set as the toner according to the exemplary embodiment, and the external additive is externally added to the toner particle and this may be set as the toner.

The toner particles may be prepared using any of a dry method (e.g., kneading and pulverizing method) and a wet method (e.g., aggregation and coalescence method, suspension and polymerization method, and dissolution and suspension method). The preparing method is not particularly limited to these preparing methods, and a known preparing method is employed. Among these, the toner particles are preferably obtained by an aggregation and coalescence method.

Specifically, for example, when the toner particles are prepared by an aggregation and coalescence method, the toner particles are prepared through: a process of preparing a polyester resin particle dispersion in which polyester resin particles are dispersed (polyester resin particle dispersion preparation process); a process of preparing styrene (meth) acrylic resin particle dispersion in which styrene (meth) acrylic resin particles are dispersed (styrene (meth)acrylic resin particle dispersion preparation process); a process of preparing a release agent dispersion in which release agent particles are dispersed (release agent dispersion preparation process); a process of aggregating resin particles (and other particles, if necessary) in a mixed dispersion obtained by mixing the two resin particle dispersions with each other (in dispersion obtained by mixing the other particle dispersion such as a colorant, too, if necessary) and forming first aggregated particles (first aggregated particle forming process); a process of mixing the first aggregated particle dispersion in which the first aggregated particles are dispersed, the polyester resin particle dispersion, and the release agent dispersion, aggregating the polyester resin particles and the release agent particles so as to adhere the particles to the surface of the first aggregated particles and forming the second aggregated particles (second aggregated particle forming process); and a process of heating the second aggregated particle dispersion in which the second aggregated particles are dispersed, to coalesce the second aggregated particles, and forming toner particles (coalescence process).

Hereinafter, the respective processes of the aggregation and coalescence method will be described in detail. In the following description, a method of obtaining the toner particles containing the colorant will be described, but the colorant is only used, if necessary. Additives other than the colorant may be used.

Resin Particle Dispersion Preparation Process

First, with the resin particle dispersion in which the polyester resin particles to be the binder resin are dispersed, a styrene (meth)acrylic resin particle dispersion in which the styrene (meth)acrylic resin particles are dispersed, a colorant dispersion in which the colorant particles are dispersed, and a release agent dispersion in which release agent particles are dispersed are prepared.

The polyester resin particle dispersion is prepared by, for example, dispersing the polyester resin particles by a surfactant in a dispersion medium.

Examples of the dispersion medium used for the polyester resin particle dispersion include aqueous mediums.

Examples of the aqueous mediums include water such as distilled water and ion exchange water, and alcohol. These may be used alone or in combination of two or more kinds thereof.

Examples of the surfactant include anionic surfactants such as sulfate ester salt, sulfonate, phosphate, and soap anionic surfactants; cationic surfactants such as amine salt and quaternary ammonium salt cationic surfactants; and nonionic surfactants such as polyethylene glycol, alkylphenol ethylene oxide adduct, and polyol nonionic surfactants. Among these, anionic surfactants and cationic surfactants are particularly used. Nonionic surfactants may be used in combination with anionic surfactants or cationic surfactants.

The surfactants may be used alone or in combination of two or more kinds thereof.

As a method of dispersing the polyester resin particles in the dispersion medium, a common dispersing method using, for example, a rotary shearing-type homogenizer, or a ball mill, a sand mill, or a Dyno Mill having media is exemplified. In addition, the polyester resin particles may be dispersed in the dispersion medium using, for example, a phase inversion emulsification method. The phase inversion emulsification method includes: dissolving a resin to be dispersed in a hydrophobic organic solvent in which the resin is soluble; performing neutralization by adding a base to an organic continuous phase (O phase); and performing phase inversion from W/O to O/W by adding water (W phase), thereby dispersing the resin as particles in the aqueous medium.

The volume average particle diameter of polyester resin particles dispersed in the polyester resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the polyester resin particles, a cumulative distribution by volume is drawn from the side of the smallest diameter with respect to particle size ranges (channels) separated using the particle size distribution obtained by the measurement with a laser diffraction-type particle size distribution measuring device (for example, LA-700 manufactured by Horiba, Ltd.), and a particle diameter when the cumulative percentage becomes 50% with respect to the entirety of the particles is measured as a volume average particle diameter D50*v*. The volume average particle diameter of the particles in other dispersion is also measured in the same manner.

The content of the polyester resin particles contained in the polyester resin particle dispersion is, for example, preferably from 5% by weight to 50% by weight, and more preferably from 10% by weight to 40% by weight.

The styrene (meth)acrylic resin particle dispersion, the colorant dispersion, and the release agent dispersion are also prepared in the same manner as in the case of the polyester resin particle dispersion. That is, the polyester resin particle dispersion is the same as the styrene (meth)acrylic resin particle dispersion, the colorant dispersion, and the release agent dispersion, in terms of the dispersion medium, the dispersing method, the volume average particle diameter of the particles, and the content of the particles.

First Aggregated Particle Forming Process

Next, the polyester resin particle dispersion, the styrene (meth)acrylic resin particle dispersion, and the colorant dispersion are mixed with each other.

The polyester resin particles, the styrene (meth)) acrylic resin particles, and the colorant particles heterogeneously aggregate in the mixed dispersion, thereby forming first aggregated particles having a diameter near a target toner particle diameter and including the polyester resin particles, the styrene (meth)acrylic resin particles, and the colorant particles.

The release agent dispersion may also be mixed if necessary, and the first aggregated particles may include the release agent particles.

Specifically, for example, an aggregating agent is added to the mixed dispersion and a pH of the mixed dispersion is adjusted to acidity (for example, the pH being from 2 to 5). If necessary, a dispersion stabilizer is added. Then, the mixed dispersion is heated at a temperature near the glass transition temperature of the polyester resin particles (specifically, for example, from a temperature 30° C. lower than the glass transition temperature of the polyester resin particles to a temperature 10° C. lower than the glass transition temperature) to aggregate the particles dispersed in the mixed dispersion, thereby forming the first aggregated particles.

In the first aggregated particle forming process, for example, the aggregating agent may be added at room temperature (for example, 25° C.) under stirring of the mixed dispersion using a rotary shearing-type homogenizer, the pH of the mixed dispersion may be adjusted to acidity (for example, the pH being from 2 to 5), a dispersion stabilizer may be added if necessary, and the heating may then be performed.

As the aggregating agent, a surfactant having an opposite polarity to the polarity of the surfactant included in the mixed dispersion, for example, inorganic metal salts and di- or higher-valent metal complexes are used. When a metal complex is used as the aggregating agent, the amount of the aggregating agent used is reduced and charging characteristics are improved.

With the aggregating agent, an additive may be used to form a complex or a similar bond with the metal ions of the aggregating agent. A chelating agent is preferably used as the additive.

Examples of the inorganic metal salts include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid; aminocarboxylic acid such as iminodiacetic acid (IDA), nitrilotriacetic acid (NTA), and ethylenediaminetetraacetic acid (EDTA).

The amount of the chelating agent added is, for example, preferably from 0.01 parts by weight to 5.0 parts by weight, and more preferably from 0.1 parts by weight to less than 3.0 parts by weight with respect to 100 parts by weight of the resin particles.

Second Aggregated Particle Forming Process

After obtaining the first aggregated particle dispersion in which the first aggregated particles are dispersed, the first aggregated particle dispersion, the polyester resin particle dispersion, and the release agent dispersion are mixed with each other. The polyester resin particle dispersion and the release agent dispersion may be mixed with each other in advance, and this mixed solution may be mixed with the first aggregated particle dispersion.

In the mixed dispersion in which the first aggregated particles, the polyester resin particles, and the release agent particles are dispersed, the particles are aggregated so as to adhere the polyester resin particles and the release agent particles to the surface of the first aggregated particles, and the second aggregated particles are formed.

Specifically, for example, in the first aggregated particle forming process, when the desired particle diameter of the first aggregated particles is achieved, the dispersion in which the polyester resin particles and the release agent particles are dispersed is mixed with the first aggregated particle dispersion. Then, this mixed dispersion is heated at a temperature equal to or lower than the glass transition temperature of the polyester resin. By setting the pH of the mixed dispersion in a range of 6.5 to 8.5, for example, the progress of the aggregation is stopped.

Accordingly, the second aggregated particles are obtained by aggregating the polyester resin particles and the release agent particles so as to adhere the surface of the first aggregated particles.

Coalescence Process

Next, the second aggregated particle dispersion in which the second aggregated particles are dispersed is heated at, for example, a temperature that is equal to or higher than the glass transition temperature of the polyester resin (for example, a temperature that is higher than the glass transition temperature of the polyester resin by 10° C. to 50° C.) to coalesce the second aggregated particles and form toner particles.

By performing the above processes, the toner particles are obtained.

After the coalescence process ends, the toner particles formed in the solution are subjected to a washing process, a solid-liquid separation process, and a drying process, that are well known, and thus dried toner particles are obtained.

In the washing process, preferably, displacement washing using ion exchange water is sufficiently performed from the viewpoint of charging properties. In addition, the solid-liquid separation process is not particularly limited, but suction filtration, pressure filtration, or the like is preferably performed from the viewpoint of productivity. The method for the drying process is also not particularly limited, but freeze drying, flash jet drying, fluidized drying, vibration-type fluidized drying, or the like is preferably performed from the viewpoint of productivity.

The toner according to the exemplary embodiment is prepared by, for example, adding and mixing an external additive to and with dried toner particles. The mixing is preferably performed with, for example, a V-blender, a Henschel mixer, a Lödige mixer, or the like. Furthermore, if necessary, coarse toner particles may be removed using a vibration sieving machine, a wind classifier, or the like.

Electrostatic Charge Image Developer

The electrostatic charge image developer according to the present exemplary embodiment is a developer including at least the toner according to the present exemplary embodiment. The electrostatic charge image developer according to the present exemplary embodiment may be a single-component developer containing only the toner according to the present exemplary embodiment, or may be a two-component developer containing a mixture of the toner and a carrier.

There is no particular limitation to the carrier and examples of the carrier include known carriers. Examples of the carrier include a coated carrier in which the surface of a core made of a magnetic particle is coated with a resin; a magnetic particle dispersed carrier in which a magnetic particle is dispersed and blended in a matrix resin; and a resin impregnated carrier in which a porous magnetic particle is impregnated with a resin. The magnetic particle dispersed carrier, and the resin impregnated carrier may be carriers each having the constitutional particle of the carrier as a core, the surface of which is coated with a resin.

Examples of the magnetic particle include magnetic metals such as iron, nickel, and cobalt; and magnetic oxides such as ferrate and magnetite.

Examples of the conductive particles include particles of metals such as gold, silver, and copper, and particles of carbon black, titanium oxide, zinc oxide, tin oxide, barium sulfate, aluminum borate, potassium titanate, or the like.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin containing an organosiloxane bond or a modified article thereof, a fluoro resin, polyesters, polycarbonates, a phenol resin, and an epoxy resin. Further, the coating resin and matrix resin may contain additives such as a conductive material.

Here, in order to coat the surface of the core with the resin, a coating method using a coating layer forming solution in which a coating resin and various kinds of additives (used as necessary) are dissolved in an appropriate solvent may be used. The solvent is not particularly limited and may be selected depending on a resin to be used and application suitability. Specific examples of the resin coating method include a dipping method including dipping a core in a coating layer forming solution, a spray method of spraying a coating layer forming solution to the surface of a core, a fluidized-bed method including spraying a coating layer forming solution to a core while the core is suspended by a fluidizing air, and a kneader coater method of mixing a core of a carrier with a coating layer forming solution in a kneader coater, and then removing the solvent.

In the two-component developer, a mixing ratio (weight ratio) of the toner and the carrier is preferably toner:carrier 1:100 to 30:100, and more preferably 3:100 to 20:100.

Image Forming Apparatus and Image Forming Method

An image forming apparatus and an image forming method according to the present exemplary embodiment will be described.

The image forming apparatus according to the present exemplary embodiment includes an image holding member; a charging unit that charges the surface of the image holding member; an electrostatic charge image forming unit that forms an electrostatic charge image on the surface of the charged image holding member; a developing unit that accommodates an electrostatic charge image developer, and develops the electrostatic charge image formed on the surface of the image holding member as a toner image using the electrostatic charge image developer; a transfer unit that transfers the toner image formed on the surface of the image holding member onto the surface of a recording medium; and a fixing unit that fixes the toner image transferred onto the surface of the recording medium. Further, as the electrostatic charge image developer, the electrostatic charge image developer according to the present exemplary embodiment is applied.

In the image forming apparatus according to the present exemplary embodiment, an image forming method (an image forming method according to the present exemplary embodiment) including charging a surface of an image holding member; forming an electrostatic charge image on the surface of the charged image holding member; developing the electrostatic charge image formed on the surface of the image holding member as a toner image using the electrostatic charge image developer according to the present exemplary embodiment; transferring the toner image formed on the surface of the image holding member onto a surface of a recording medium; and fixing the toner image transferred onto the surface of the recording medium is carried out.

As the image forming apparatus according to the present exemplary embodiment, known image forming apparatuses such as a direct transfer type image forming apparatus which directly transfers a toner image formed on a surface of an image holding member onto a recording medium; an intermediate transfer type image forming apparatus which primarily transfers a toner image formed on a surface of an image holding member onto a surface of an intermediate transfer member and secondarily transfers the toner image transferred on the surface of the intermediate transfer member onto a surface of a recording medium; an image forming apparatus including a cleaning unit which cleans a surface of an image holding member after a toner image is transferred and before charging; and an image forming apparatus including an erasing unit which erases a charge from a surface of an image holding member after a toner image is transferred and before charging by irradiating the surface with easing light is applied.

In the case where the image forming apparatus according to the present exemplary embodiment is an intermediate transfer type apparatus, for example, a configuration in which a transfer unit includes an intermediate transfer member to the surface of which a toner image is transferred, a primary transfer unit which primarily transfers the toner image formed on the surface of the image holding member onto the surface of the intermediate transfer member, and a secondary transfer unit which secondarily transfers the toner image transferred onto the surface of the intermediate transfer member onto the surface of a recording medium is applied.

In the image forming apparatus according to the present exemplary embodiment, for example, a portion including the developing unit may have a cartridge structure (process cartridge) which is detachable from the image forming apparatus. As the process cartridge, for example, a process cartridge which is provided with the developing unit which accommodates the electrostatic charge image developer according to the present exemplary embodiment is suitably used.

Hereinafter, an example of the image forming apparatus according to the present exemplary embodiment will be described, but the invention is not limited thereto. In the following description, main components shown in the drawing will be described, and the descriptions of the other components will be omitted.

FIG. 1 is a schematic configuration diagram showing an image forming apparatus according to the present exemplary embodiment.

The image forming apparatus shown in FIG. 1 includes first to fourth electrophotographic image forming units (image forming units) 10Y, 10M, 10C, and 10K which output images of the respective colors including yellow (Y), magenta (M), cyan (C), and black (K) on the basis of color-separated image data. These image forming units (hereinafter, also referred to simply as "units" in some cases) 10Y, 10M, 10C, and 10K are arranged horizontally in a line with predetermined distances therebetween. These units 10Y, 10M, 10C, and 10K may be each a process cartridge which is detachable from the image forming apparatus.

An intermediate transfer belt 20 is provided through each unit as an intermediate transfer member extending above each of the units 10Y, 10M, 10C and 10K in the drawing. The intermediate transfer belt 20 is provided by being wound around a drive roller 22 and a support roller 24 contacting the inner surface of the intermediate transfer belt 20. The intermediate transfer belt 20 travels in a direction from the first unit 10Y to the fourth unit 10K. Incidentally, the support roller 24 is pushed in a direction separating from the drive roller 22 by a spring or the like which is not shown, such that tension is applied to the intermediate transfer belt 20 which is wound around the support roller 24 and the drive roller 22. Further, on the surface of the image holding member side of the intermediate transfer belt 20, an intermediate transfer member cleaning device 30 is provided opposing the drive roller 22.

In addition, toners in the four colors of yellow, magenta, cyan and black, which are accommodated in toner cartridges 8Y, 8M, 8C and 8K, respectively, are supplied to developing devices (developing units) 4Y, 4M, 4C, and 4K of the above-described units 10Y, 10M, 10C and 10K, respectively.

Since the first to fourth units 10Y, 10M, 10C, and 10K have the same configuration, the first unit 10Y, which is provided on the upstream side in the travelling direction of the intermediate transfer belt and forms a yellow image, will be described as a representative example.

The first unit 10Y includes a photoreceptor 1Y functioning as the image holding member. In the surroundings of the photoreceptor 1Y, there are successively disposed a charging roller (an example of the charging unit) 2Y for charging the surface of the photoreceptor 1Y to a predetermined potential; an exposure device (an example of the electrostatic charge image forming unit) 3 for exposing the charged surface with a laser beam 3Y on the basis of a color-separated image signal to form an electrostatic charge image; the developing device (an example of the developing unit) 4Y for supplying a charged toner into the electrostatic charge image to develop the electrostatic charge image; a primary transfer roller (an example of the primary transfer unit) 5Y for transferring the developed toner image onto the intermediate transfer belt 20; and a photoreceptor cleaning device (an example of the cleaning unit) 6Y for removing the toner remaining on the surface of the photoreceptor 1Y after the primary transfer.

The primary transfer roller 5Y is disposed inside the intermediate transfer belt 20 and provided in a position facing the photoreceptor 1Y. Further, bias power supplies (not shown), which apply primary transfer biases, are respectively connected to the primary transfer rollers 5Y, 5M, 5C, and 5K of the respective units. A controller (not shown) controls the respective bias power supplies to change the primary transfer bias values which are applied to the respective primary transfer rollers.

Hereinafter, the operation of forming a yellow image in the first unit 10Y will be described.

First, before the operation, the surface of the photoreceptor 1Y is charged to a potential of −600 V to −800 V by the charging roller 2Y.

The photoreceptor 1Y is formed by stacking a photosensitive layer on a conductive substrate (volume resistivity at 20° C.: $1\times10^{-6}$ Ωcm or lower). In general, this photosensitive layer has high resistance (resistance similar to that of general resin), and has properties in which, when irradiated with the laser beam, the specific resistance of a portion irradiated with the laser beam changes. Therefore, the laser beam 3Y is output to the charged surface of the photoreceptor 1Y through the exposure device 3 in accordance with yellow image data sent from the controller (not shown). As a result, an electrostatic charge image having a yellow image pattern is formed on the surface of the photoreceptor 1Y.

The electrostatic charge image is an image which is formed on the surface of the photoreceptor 1Y by charging and is a so-called negative latent image which is formed when the specific resistance of a portion, which is irradiated with the laser beam 3Y, of the photosensitive layer is reduced and the charge flows on the surface of the photoreceptor 1Y and, in contrast, the charge remains in a portion which is not irradiated with the laser beam 3Y.

The electrostatic charge image which is formed on the photoreceptor 1Y in this manner is rotated to a predetermined development position along with the travelling, of the photoreceptor 1Y. At this development position, the electrostatic charge image on the photoreceptor 1Y is developed and visualized as a toner image by the developing device 4Y.

The developing device 4Y accommodates, for example, the electrostatic charge image developer, which contains at least a yellow toner and a carrier. The yellow toner is frictionally charged by being stirred in the developing device 4Y to have a charge with the same polarity (negative polarity) as that of a charge on the photoreceptor 1Y and is maintained on a developer roller (an example of the developer holding member). When the surface of the photoreceptor 1Y passes through the developing device 4Y, the yellow toner is electrostatically attached to a latent image portion which has been erased on the surface of the photoreceptor 1Y, and the latent image is developed with the yellow toner. The photoreceptor 1Y on which a yellow toner image is formed continuously travels at a predetermined rate, and the toner image developed on the photoreceptor 1Y is transported to a predetermined primary transfer position.

When the yellow toner image on the photoreceptor 1Y is transported to the primary transfer position, a primary transfer bias is applied to the primary transfer roller 5Y, an electrostatic force directed from the photoreceptor 1Y toward the primary transfer roller 5Y acts upon the toner image, and the toner image on the photoreceptor 1Y is transferred onto the intermediate transfer belt 20. The transfer bias applied at this time has a (+) polarity opposite to the polarity (−) of the toner and for example, in the first unit 10Y, is controlled to +10 μA by the controller (not shown).

Meanwhile, the toner remaining on the photoreceptor 1Y is removed and collected by the photoreceptor cleaning device 6Y.

Also, primary transfer biases to be applied respectively to the primary transfer rollers 5M, 5C, and 5K of the second unit 10M and subsequent units, are controlled similarly to the primary transfer bias of the first unit.

In this manner, the intermediate transfer belt 20 having a yellow toner image transferred thereonto in the first unit 10Y is sequentially transported through the second to fourth units 10M, 10C, and 10K, and toner images of respective colors are superimposed and multi-transferred.

The intermediate transfer belt 20 having the four-color toner images multi-transferred thereonto through the first to fourth units arrives at a secondary transfer portion which is configured with the intermediate transfer belt 20, the support roller 24 coming into contact with the inner surface of the intermediate transfer belt and a secondary transfer roller 26 (an example of the secondary transfer unit) disposed on the side of the image holding surface of the intermediate transfer belt 20. Meanwhile, a recording sheet P (an example of the recording medium) is supplied to a gap at which the secondary transfer roller 26 and the intermediate transfer belt 20 are brought into contact with each other at a predetermined timing through a supply mechanism and a secondary transfer bias is applied to the support roller 24. The transfer bias applied at this time has the same (−) polarity as the polarity (−) of the toner, and an electrostatic force directing from the intermediate transfer belt 20 toward the recording sheet P acts upon the toner image, whereby the toner image on the intermediate transfer belt 20 is transferred onto the recording sheet P. Incidentally, on this occasion, the secondary transfer bias is determined depending upon a resistance detected by a resistance detecting unit (not shown) for detecting a resistance of the secondary transfer portion, and the voltage is controlled.

Thereafter, the recording sheet P is sent to a press contact portion (nip portion) of a pair of fixing rollers in a fixing device 28 (an example of the fixing unit), and the toner image is fixed onto the recording sheet P to forma fixed image.

Examples of the recording sheet P onto which the toner image is transferred include plain paper used for electrophotographic copying machines, printers and the like. As the recording medium, other than the recording sheet P, OHP sheets may be used.

In order to improve the smoothness of the image surface after the fixing, the surface of the recording sheet P is preferably smooth, and for example, coated paper in which the surface of plain paper is coated with a resin and the like, art paper for printing, and the like are suitably used.

The recording sheet P in which fixing of a color image is completed is transported to an ejection portion, whereby a series of the color image formation operations ends.

Process Cartridge and Toner Cartridge

A process cartridge according to the present exemplary embodiment will be described.

The process cartridge according to the present exemplary embodiment includes a developing unit, which accommodates the electrostatic charge image developer according to the present exemplary embodiment and develops an electrostatic charge image formed on an image holding member as a toner image using the electrostatic charge image developer, and is detachable from an image forming apparatus.

The configuration of the process cartridge according to the present exemplary embodiment is not limited thereto and may include a developing device and, additionally, at least one selected from other units such as an image holding member, a charging unit, an electrostatic charge image forming unit, and a transfer unit, as necessary.

Hereinafter, an example of the process cartridge according to the present exemplary embodiment will be shown but the process cartridge is not limited thereto. Main components shown in the drawing will be described, and the descriptions of the other components will be omitted.

Figure 2:
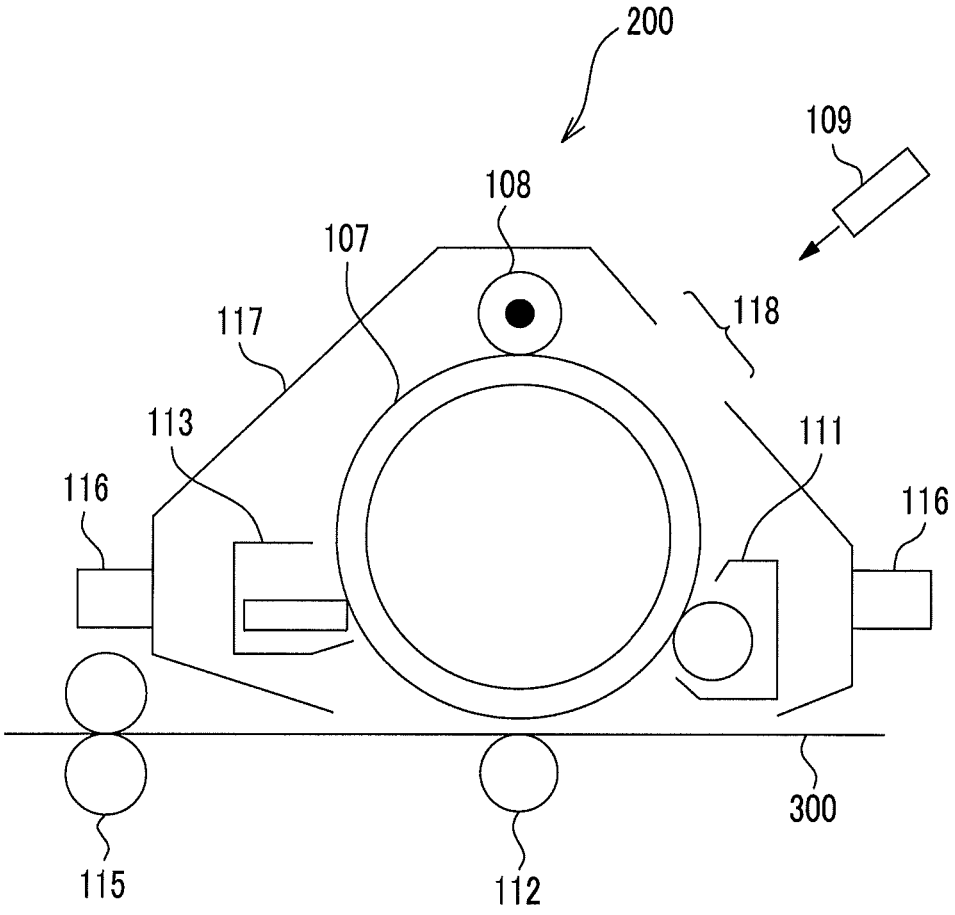
FIG. 2 is a schematic configuration diagram showing an example of a process cartridge according to the present exemplary embodiment.

FIG. 2 is a schematic configuration diagram showing a process cartridge according to an exemplary embodiment.

A process cartridge 200 shown in FIG. 2 includes, a photoreceptor 107 (an example of the image holding member), and a charging roller 108 (an example of the charging unit), a developing device 111 (an example of the developing unit) and a photoreceptor cleaning device 113 (an example of the cleaning unit) provided in the periphery of the photoreceptor 107, all of which are integrally combined and supported, for example, by a housing 117 provided with a mounting rail 116 and an opening portion 118 for exposure to form a cartridge.

In FIG. 2, 109 denotes an exposure device (an example of the electrostatic charge image forming unit), 112 denotes a transfer device (an example of the transfer unit), 115 denotes a fixing device (an example of the fixing unit), and 300 denotes recording sheet (an example of the recording medium).

Next, a toner cartridge according to the present exemplary embodiment will be described.

The toner cartridge according to the present exemplary embodiment is a toner cartridge which accommodates the toner according to the present exemplary embodiment and is detachable from an image forming apparatus. The toner cartridge accommodates the toner for replenishment to be supplied to the developing unit provided in the image forming apparatus.

The image forming apparatus shown in FIG. 1 is an image forming apparatus having a configuration in which the toner cartridges 8Y, 8M, 8C and 8K are detachably attached, and the developing devices 4Y, 4M, 4C, and 4K are connected to toner cartridges corresponding to the respective colors via a toner supply line (not shown). Further, in the case where the toner accommodated in the toner cartridge runs low, the toner cartridge is replaced.

EXAMPLES

Hereinafter, the present exemplary embodiments are more specifically described with reference to Examples, but it should be construed that the exemplary embodiments are not limited to these Examples. In the following description, "parts" and "%" denoting the amounts are each on the basis of weight, unless otherwise indicated.

Preparation of Polyester Resin Particle Dispersion

Preparation of Polyester Resin Particle Dispersion (1)

Bisphenol A/ethylene oxide 2.2-mol adduct: 40 parts by mole

Bisphenol A/propylene oxide 2.2-mol adduct: 60 parts by mole

Dimethyl terephthalate: 60 parts by mole

Dimethyl fumarate: 15 parts by mole

Dodecenylsuccinic anhydride: 20 parts by mole

Trimellitic anhydride: 5 parts by mole

The above components excluding dimethyl fumarate and trimellitic acid anhydride and 0.25 parts of tin dioctanoate based on 100 parts of the total amount of the aforementioned components are put in a reaction vessel including a stirrer, a thermometer, a condenser, and a nitrogen gas introduction tube. Under a nitrogen gas flow, the reaction of the mixture is conducted at 235° C. for 6 hours, and then the temperature is lowered to 200° C. Dimethyl fumarate and trimellitic acid anhydride are put thereinto and the reaction of the mixture is conducted for 1 hour. The temperature is elevated to 220° C. over 5 hours and polymerization is conducted under a pressure of 10 kPa until a desired molecular weight is obtained, thereby obtaining a pale yellow transparent amorphous polyester resin.

The amorphous polyester resin has a weight average molecular weight of 35,000, a number average molecular weight of 8,000, and a glass transition temperature of 59° C.

Next, the obtained amorphous polyester is dispersed using a dispersing machine obtained by modifying a Cavitron CD 1010 (manufactured by EUROTEC Limited) into a high temperature and high pressure type. The CAVITRON is operated at a composition ratio of 80% of ion exchange water and 20% of the polyester resin, with the pH being adjusted to 8.5 with ammonia, and under the conditions of a rotation rate of a rotor of 60 Hz, a pressure of 5 $Kg/m^2$, and a temperature of 140° C. by heating using a heat exchanger, thereby obtaining an amorphous polyester resin dispersion.

The volume average particle diameter of the resin particles in the dispersion is 130 nm. The solid content thereof is adjusted to 20% by adding ion exchange, water to the dispersion, thereby affording a polyester resin particle dispersion (1).

Preparation of Polyester Resin Particle Dispersion (2)

1,10-Dodecanedioic acid: 50 parts by mole 1,9-Nonanediol: 50 parts by mole

The aforementioned monomers are put in a reaction vessel including a stirrer, a thermometer, a condenser, and a nitrogen gas introduction tube. The reaction vessel is purged with dry nitrogen gas and then, 0.25 parts of titanium tetrabutoxide based on 100 parts of the monomers is put thereinto. The reaction of the mixture is conducted at 170° C. for 3 hours under nitrogen gas flow. Then, the temperature is elevated to 210° C. over 1 hour, the pressure inside the reaction vessel is lowered to 3 kPa, and the reaction is conducted under stirring for 13 hours under reduced pressure, thereby obtaining a crystalline polyester resin.

The crystalline polyester resin has a weight average molecular weight of 25,000, a number average molecular weight of 10,500, an acid value of 10.1 mgKOH/g, and a melting temperature as measured by DSC of 73.6° C.

Next, the obtained crystalline polyester is dispersed using a dispersing machine obtained by modifying a Cavitron CD 1010 (manufactured by EUROTEC Limited) into a high temperature and high pressure type. The CAVITRON as operated at a composition ratio of 80% of ion exchange water and 20% of the polyester resin, with the pH being adjusted to 8.5 with ammonia, and under the conditions of a rotation rate of a rotor of 60 Hz, a pressure of 5 $Kg/cm^2$, and a temperature of 140° C. by heating using a heat exchanger, thereby obtaining a crystalline polyester resin dispersion.

The volume average particle diameter of the resin particles in the dispersion is 180 nm. The solid content thereof is adjusted to 20% by adding ion exchange water to the dispersion, thereby affording a polyester resin particle dispersion (2).

Preparation of Styrene (meth)acrylic Resin Particle Dispersion

Preparation of Styrene Acrylic Resin Particle Dispersion (1)

Styrene: 77 parts n-Butyl acrylate: 23 parts 1,10-Dodecanediol diacrylate: 0.4 parts Dodecanethiol: 0.7 parts To a solution obtained by mixing and dissolving the aforementioned materials is added a solution obtained by dissolving 1.0 part of an anionic surfactant (Dowfax, manufactured by The Dow Chemical Company) in 60 parts of ion-exchange water, and the mixture is dispersed and emulsified in the flask to prepare an emulsion of the monomers.

Then, 2.0 parts of an anionic surfactant (Dowfax, manufactured by The Dow Chemical Company) are dissolved in 90 parts of ion exchange water, 2.0 parts of the emulsion of the monomers above are added thereto, and in addition, 10 parts of ion exchange water having 1.0 part of ammonium persulfate dissolved therein are put into the mixture.

Thereafter, the residue of the emulsion of the monomers is put into the mixture over 3 hours and the nitrogen purge in the flask is performed. Then, the solution in the flask is heated in an oil bath under stirring until it reaches 65° C. The mixture is continuously emulsion-polymerized for 5 hours as it is to obtain a styrene acrylic resin particle dispersion (1). The styrene acrylic resin particle dispersion (1) is adjusted to a solid content of 32% by the addition of ion exchange water.

The particles in the styrene acrylic resin particle dispersion (1) have a volume average particle diameter of 102 nm and a weight average molecular weight of 55000.

Preparation of Styrene Acrylic Resin Particle Dispersion (2)

By the same method as for the preparation method for the styrene acrylic resin particle dispersion (1) except that 1.5 parts of an anionic surfactant (Dowfax, manufactured by The Dow Chemical Company) is dissolved in 90 parts of ion exchange water, 2.0 parts of the emulsion of the monomers above are added thereto, and in addition, 10 parts of ion exchange water having 1.0 part of ammonium persulfate dissolved therein is put to the mixture, a styrene acrylic resin particle dispersion (2) having a solid content of 32% is obtained. The particles in the styrene acrylic resin particle dispersion (2) have a volume average particle diameter of 204 nm and a weight average molecular weight of 54000.

Preparation of Styrene Acrylic Resin Particle Dispersion (3)

By the same method as for the preparation method for the styrene acrylic resin particle dispersion (2) except that the addition amounts of the anionic surfactant (Dowfax, manufactured by The Dow Chemical Company) and the emulsion of the monomers above are changed to 2.0 parts and 20 parts, respectively, a styrene acrylic resin particle dispersion (3) having a solid content of 32% is obtained. The particles in the styrene acrylic resin particle dispersion (3) have a volume average particle diameter of 74 nm and a weight average molecular weight of 55000.

Preparation of Styrene Acrylic Resin Particle Dispersion (4)

By the same method as for the preparation method for the styrene acrylic resin particle dispersion (2) except that the addition amount of the anionic surfactant (Dowfax, manufactured by The Dow Chemical Company) is changed to 1.0 part, a styrene acrylic resin particle dispersion (4) having a solid content of 32% is obtained. The particles in the styrene acrylic resin particle dispersion (4) have a volume average particle diameter of 310 nm and a weight average molecular weight of 53000.

Preparation of Styrene Acrylic Resin Particle Dispersion (5)

By the same method as for the preparation method for the styrene acrylic resin particle dispersion (2) except that the addition amounts of the anionic surfactant (Dowfax, manufactured by The Dow Chemical Company) and the emulsion of the monomers above are changed to 4.0 parts and 40 parts, respectively, a styrene acrylic resin particle dispersion (5) having a solid content of 32% is obtained. The particles in the styrene acrylic resin particle dispersion (5) have a volume average particle diameter of 48 nm and a weight average molecular weight of 54000.

Preparation of Colorant Dispersion

Preparation of Black Pigment Dispersion (1)

Carbon Black (manufactured by Cabot Corporation, Regal 330): 250 parts

Anionic surfactant (NEOGEN SC, manufactured by DAI-ICHI KOGYO SEIYAKU CO., LTD.): 33 parts (active ingredient content of 60%, 8% with respect to the colorant)

Ion exchange water: 750 parts

In a stainless steel vessel having a size such that when the entire amount of the materials shown above are put in, the level of the liquid is about one-third of the height of the vessel, 280 parts of ion exchange water and 33 parts of the anionic surfactant are put, and the surfactant is sufficiently dissolved therein. Subsequently, all of the carbon black is put into the vessel, and the mixture is stirred using a stirrer until unwetted pigment is no longer seen, while the mixture is sufficiently defoamed. After defoaming, the rest of the ion exchange water is added, and the resultant is dispersed using a homogenizer (ULTRA TURRAX T50, manufactured by IKA Japan K.K.) at 5000 rpm for 10 minutes, and then the dispersion is defoamed by stirring for one whole day and night using a stirrer. After defoaming, the resultant is dispersed using the homogenizer again at 6000 rpm for 10 minutes, and then the dispersion is defoamed by stirring for one whole day and night using a stirrer. Subsequently, the dispersion is dispersed under a pressure of 240 MPa using a high pressure impact type dispersing machine, ULTIMIZER (HJP30006, manufactured by Sugino Machine, Ltd.). The dispersion is carried out to an extent equivalent to 25 passes in terms of the total feed amount and the processing capability of the device. The dispersion thus obtained is kept for 72 hours to remove any precipitate, and ion exchange water is added thereto to adjust the solid content to 15% to obtain a black pigment dispersion (1). The particles in the black pigment dispersion (1) have a volume average particle diameter of 135 nm.

Preparation of Release Agent Dispersion

Preparation of Release Agent Dispersion (1)

Polyethylene wax (hydrocarbon wax, POLYWAX 725, manufactured by Baker-Petrolite Co., Ltd., melting temperature of 104° C.): 270 parts Anionic surfactant (NEOGEN RK, manufactured by DAI-ICHI KOGYO SEIYAKU CO., LTD.): 13.5 parts (active ingredient of 60%, 3% with respect to the release agent)

Ion exchange water: 21.6 parts

The aforementioned materials are mixed, and the release agent is dissolved using a pressure discharge homogenizer (manufactured by APV Gaulin, Inc., Gaulin Homogenizer) at an internal liquid temperature of 120° C. Subsequently, the mixture is subjected to a dispersion treatment for 120 minutes at a dispersion pressure of 5 MPa, and for 360 minutes at a dispersion pressure of 40 MPa and is cooled, thereby obtaining a dispersion. Then, solid content thereof is adjusted to 20% by adding ion exchange water to the dispersion, thereby obtaining release agent dispersion (1). The particles in the release agent dispersion (1) have a volume average particle diameter of 225 nm.

Preparation of Release Agent Dispersion (2)

By the same method as for the preparation method for the release agent dispersion (1) except that the polyethylene wax is changed to a paraffin wax (hydrocarbon wax, HNP 0190 manufactured by Nippon Seiro Co., Ltd., melting temperature of 85° C.), a release agent dispersion (2) is obtained.

Preparation of Release Agent Dispersion (3)

By the same method as for the preparation method for the release agent dispersion (1) except that the polyethylene wax is changed to a paraffin wax (hydrocarbon wax, HNP 9 manufactured by Nippon Seiro Co., Ltd., melting temperature of 75° C.), a release agent dispersion (3) is obtained.

Preparation of Release Agent Dispersion (4)

By the same method as for the preparation method for the release agent dispersion (1) except that the polyethylene wax is changed to a polyethylene wax (hydrocarbon wax, POLYWAX 1000 manufactured by Baker-Petrolite Co., Ltd., melting temperature of 113° C.), a release agent dispersion (4) is obtained.

Preparation of Release Agent Dispersion (5)

By the same method as for the preparation method for the release agent dispersion (1) except that the polyethylene wax is changed to a synthetic wax copolymer of α-olefin and maleic anhydride (synthetic wax, DIACARNA manufactured by Mitsubishi Chemical Co., Ltd., melting temperature of 74° C.), a release agent dispersion (5) is obtained.

Preparation of Mixed Particle Dispersion

Preparation of Mixed Particle Dispersion (1)

400 parts of the polyester resin particle dispersion (1), 60 parts of the release agent dispersion (1), and 2.9 parts of the anionic surfactant (Dowfax2A1, manufactured by The Dow Chemical Company) are mixed, and then 1.0% nitric acid is added thereto at a temperature of 25° C. to adjust the pH to 3.0, thereby obtaining a mixed particle dispersion (1).

Preparation of Mixed Particle Dispersions (2) to (5)

In the same manner as in the preparation method for the mixed particle dispersion (1) except that the release agent dispersion (1) is changed to each of the release agent dispersions (2) to (5), mixed particle dispersions (2) to (5) are obtained.

Example 1

Preparation of Toner Particles

Polyester resin particle dispersion (1): 700 parts

Polyester resin particle dispersion (2): 50 parts

Styrene acrylic resin particle dispersion (1): 160 parts

Styrene acrylic resin particle dispersion (2): 45 parts

Black pigment dispersion (1): 133 parts

Release agent dispersion (1): 10 parts

Release agent dispersion (4): 5 parts

Ion exchange water: 600 parts

Anionic surfactant (Dowfax2A1 manufactured by The Dow Chemical Company): 2.9 parts The aforementioned materials are put into a 3-liter reaction vessel provided with a thermometer, a pH meter, and a stirrer, and 1.0% nitric acid is added thereto at a temperature of 25° C. to adjust the pH to 3.0. Subsequently, while the mixture is dispersed at 5,000 rpm using a homogenizer (ULTRA TURRAX T50, manufactured by IKA Japan K.K.), 100 parts of a 2.0% aqueous aluminum sulfate solution is added to the reaction vessel, and the mixture is dispersed for 6 minutes.

Subsequently, the reaction vessel is provided with a stirrer and a mantle heater, and while the rotation rate of the stirrer is adjusted so that the slurry is sufficiently stirred, the temperature is increased at a rate of 0.2° C./min up to a temperature of 40° C., and is increased at a rate of 0.05° C./min from a temperature of 40° C. to a temperature of 53° C. The particle diameter is measured every 10 minutes using a MULTISIZER II (aperture diameter of 50 μm, manufactured by Beckman Coulter, Inc.). At a point when the volume average particle diameter reaches 5.0 μm, the temperature is maintained, and 460 parts of the mixed particle dispersion (1) is put thereinto over 5 minutes.

The mixture is maintained at 50° C. for 30 minutes, 8 parts of a 20% solution of ethylenediamine tetraacetate (EDTA) is added to the reaction vessel to stop the growth of the aggregated particles forming a coating layer, and then a 1 mol/L aqueous sodium hydroxide solution is added thereto to control the pH of the raw material dispersion to 9.0. Subsequently, while the pH is adjusted to 9.0 at every increment of 5° C., the temperature is increased to 90° C. at a rate of temperature increase of 1° C./min, and the mixture is maintained at 90° C. The particle shape and the surface properties are observed using an optical microscope and a field emission scanning electron microscope (FE-SEM), and the coalescence of particles is confirmed after 6 hours. Therefore, the reaction vessel is cooled to 30° C. in cooling water over 5 minutes.

The slurry after cooling is passed through a nylon mesh having a mesh size of 15 μm, and coarse powder is removed. The toner slurry that has passed through the mesh is subjected to filtration under reduced pressure using an aspirator. The solid contents left on the filter paper are pulverized by hand as finely as possible, and the pulverized toner is put into ion exchange water in an amount equivalent to 10 times the amount of the solid contents at a temperature of 30° C. The mixture is mixed under stirring for 30 minutes, and then is subjected to reduced pressure filtration with an aspirator. The ion exchange water 10 times the amount of the solid contents at a temperature of 30° C. is added, the mixture is mixed under stirring for 30 minutes and then is subjected again to reduced pressure filtration with an aspirator. The electrical conductivity of the filtrate is measured. This operation is repeated until the electrical conductivity of the filtrate reaches 10 μS/cm or less, and the solid contents are washed.

The washed solid contents are pulverized finely with a wet and dry granulator (COMIL), and then dried in vacuo in an oven at 35° C. for 36 hours to obtain toner particles. The toner particles have a volume average particle diameter of 6.0 μm.

Preparation of Silica Particles

A stirrer, a dropping funnel, and a thermometer are set in a glass reactor, 15 parts of ethanol and 28 parts of tetraethoxysilane are put thereinto, and the mixture is stirred at a rotation of 100 rpm while keeping the temperature at 35° C. Next, while keeping stirring, 30 parts of an aqueous ammonia solution at a concentration of 20% is added dropwise thereto over 5 minutes. After the reaction is conducted as it is for 1 hour, centrifuge is conducted to remove the supernatant. Further, 100 parts of toluene is added thereto to prepare a suspension, and 60% by weight of hexamethyldisilaze with respect to the solid content in the suspension is added thereto, followed by performing the reaction at 95° C. for 4 hours. Thereafter, the suspension is heated to remove toluene, dried, and then sieved through a mesh of 106 μm to remove coarse powder, thereby obtaining silica particles having a number average particle diameter of 120 nm.

Preparation of Toner 100 parts of toner particles and 1.5 parts of silica particles are mixed and treated by a Henschel mixer at a peripheral velocity of 20 m/s for 15 minutes, and filtered through a sieve having an opening of 45 μm to remove coarse particles, thereby obtaining a toner.

Preparation of Carrier 500 parts of spherical magnetite particle powder having a volume average particle diameter of 0.18 μm is put into a Henschel mixer, and is sufficiently stirred, and then 5 parts of a titanate coupling agent is added thereto. The mixture is warmed to a temperature of 95° C. and stirred under mixing for 30 minutes, thereby obtaining a spherical magnetite particle coated with the titanate coupling agent.

Then, 6 parts of phenol, 10 parts of 30% formalin, 500 parts of magnetite particles, 7 parts of 25% ammonia aqueous solution, and 400 parts of water are put into a 1-liter four-necked flask, and then mixed and stirred. Next, while stirring, the mixture is heated to a temperature of 90° C. for 60 minutes, reacted at the same temperature for 180 minutes, and then cooled to 30° C. 500 ml of water is added thereto, the supernatant is removed, and the precipitate is washed with water. The resultant is dried at 180° C. under reduced pressure and filtered through a sieve having an opening of 106 μm to remove coarse powder, thereby obtaining core particles having an average particle diameter of 38 μm.

Next, 200 parts of toluene and 35 parts of a styrene-methyl methacrylate copolymer (component molar ratio of 10:90, weight average molecular weight of 160,000) are stirred with a stirrer for 90 minutes, thereby obtaining a coat resin solution.

1000 parts of core particles and 70 parts of a coat resin solution are put into a vacuum-deaeration type kneader coater (clearance between the rotor and the wall surface of 35 mm), kept to 65° C., stirred at 30 rpm for 30 minutes, and then kept at a temperature of 88° C. Evaporation of toluene and deaeration are conducted under reduced pressure, and the resultant is dried. Then, the resultant is passed though a mesh having an opening of 75 μm. The shape factor SF2 of the carrier is 104.

Preparation of Developer 8 parts of a toner and 100 parts of a carrier are mixed by a V-blender to prepare a developer.

Examples 2 to 15 and Comparative Examples 1 to 4

By the same method as in Example 1, using the materials shown in Table 1, the toner particle, the toner, and the developer of each of Examples and Comparative Examples are obtained.

Comparative Example 5

By the same method as in Example 1, using the materials shown in Table 1, except for changing the release agent dispersion (1) and the release agent dispersion (4) in Example 1 to 15 parts of the release agent dispersion (5), the toner particle, the toner, and the developer of Comparative Example 5 are obtained.

Evaluation

For the toner particles of each of Examples and Comparative Examples, the presence ratio of the release agents, the average diameter of the domains, and the distribution of the domain diameters are examined by the methods as described above. The results are shown in Table 1.

The developer of each of Examples and Comparative Examples is filled into a developer unit of an image forming apparatus (DocuPrint P450d, manufactured by FUJI XEROX Co., Ltd., process speed of 260 mm/s, and fixing pressure of the fixing device of 0.20 N/mm$^2$). Using this image forming apparatus, the following evaluation is carried out. The evaluation results are shown in Table 1.

Offset

Under a high humidity environment (temperature of 30° C./humidity of 80%), it is confirmed that the inside of the image forming apparatus is a high-humidity environment, and then the image forming apparatus is powered on. Further, charts having a 3 cm×15 cm solid are continuously printed on 30 sheets of paper (Premier 80 manufactured by Xerox, A4 size), on the positions of 3 cm, 13 cm, and 22 cm in the length direction from one end of paper.

Ten sheets of the same type of paper (that is Premier 80) are placed under the print samples, and one sheet of the same type of paper (that is Premier 80) is overlaid on the print sample. 200 g of a load is applied thereonto with a position pin for jig (ELNNA-10-P10-315, manufactured by MISUMI Corporation), and one straight line bisecting the width direction of the paper is drawn. This operation is carried out with the $5^{th}$, $10^{th}$, $15^{th}$, $20^{th}$, $25^{th}$, and $30^{th}$ print samples, the back side of paper and the print samples are observed with the naked eye, and the offset is evaluated according to the following evaluation criteria.

Evaluation Criteria

A: Offset is not observed in back side of paper and the missing of an image in the printed sample is not observed.

B: Slight offset is observed in back side of paper in some places and some missing of an image in the printed sample is observed, but these are not problematic in practical use.

C: Offset is observed in back side of paper and missing of an image in the printed sample is clearly observed, and these are substantially problematic in practical use.

D: Offset is observed in back side of paper over the entire straight line written and the missing of an image in the printed sample is observed.

TABLE 1

| | Material (parts by weight) | | | | | | | |
|---|---|---|---|---|---|---|---|---|
| | Polyester resin particle dispersion (1) | Polyester resin particle dispersion (2) | Styrene acrylic resin particle dispersion (1) | Styrene acrylic resin particle dispersion (2) | Styrene acrylic resin particle dispersion (3) | Styrene acrylic resin particle dispersion (4) | Styrene acrylic resin particle dispersion (5) | Mixed particle dispersion |
| Example 1 | 700 | 50 | 160 | 45 | — | — | — | (1)460 |
| Example 2 | 730 | 50 | 160 | 45 | — | — | — | (1)400 |
| Example 3 | 640 | 50 | 160 | 45 | — | — | — | (1)500 |
| Example 4 | 740 | 50 | 160 | 45 | — | — | — | (1)420 |
| Example 5 | 700 | 50 | 25 | — | 140 | — | 40 | (1)460 |
| Example 6 | 700 | 50 | 105 | 80 | 20 | — | — | (1)460 |
| Example 7 | 700 | 50 | 75 | 120 | 10 | — | — | (1)460 |
| Example 8 | 700 | 50 | 165 | 15 | 20 | — | — | (1)460 |
| Example 9 | 700 | 50 | 180 | 15 | 10 | — | 10 | (1)460 |
| Example 10 | 700 | 50 | 195 | 10 | — | — | — | (1)460 |
| Example 11 | 700 | 50 | 145 | 20 | 20 | — | 20 | (1)460 |
| Example 12 | 700 | 50 | 150 | 20 | 25 | — | 10 | (1)460 |
| Example 13 | 700 | 50 | 160 | 45 | — | — | — | (2)460 |
| Example 14 | 700 | 50 | 160 | 45 | — | — | — | (3)460 |
| Example 15 | 700 | 50 | 160 | 45 | — | — | — | (4)460 |
| Comparative Example 1 | 700 | 50 | 160 | 45 | — | — | — | (1)460 |
| Comparative Example 2 | 700 | 50 | 10 | — | 15 | — | 180 | (1)460 |
| Comparative Example 3 | 700 | 50 | 20 | 10 | 5 | 170 | — | (1)460 |
| Comparative Example 4 | 700 | 50 | 195 | 5 | 5 | — | — | (1)460 |
| Comparative Example 5 | 700 | 50 | 160 | 45 | — | — | — | (5)460 |

| | Toner particles | | | | | |
|---|---|---|---|---|---|---|
| | Volume average particle diameter | Presence ratio of the release agents within 800 nm from the surface | Average diameter of the domains of styrene (meth)acrylic resin | Number ratio of domain included in a range of an average diameter ± 0.1 μm | Number ratio of domain included in a range of an average diameter ± 0.2 μm | Evaluation Offset |
| Example 1 | 6.0 μm | 82% | 0.62 μm | 52% | 92% | A |
| Example 2 | 5.8 μm | 71% | 0.65 μm | 48% | 88% | B |
| Example 3 | 6.1 μm | 92% | 0.61 μm | 54% | 98% | A |
| Example 4 | 6.0 μm | 75% | 0.61 μm | 53% | 91% | A |
| Example 5 | 6.1 μm | 81% | 0.31 μm | 60% | 95% | B |
| Example 6 | 6.2 μm | 81% | 0.74 μm | 48% | 88% | A |
| Example 7 | 6.0 μm | 79% | 0.78 μm | 42% | 84% | B |
| Example 8 | 5.9 μm | 81% | 0.52 μm | 32% | 91% | A |
| Example 9 | 6.2 μm | 79% | 0.56 μm | 18% | 98% | A |
| Example 10 | 6.0 μm | 82% | 0.54 μm | 64% | 98% | B |
| Example 11 | 6.2 μm | 81% | 0.63 μm | 47% | 81% | B |
| Example 12 | 6.1 μm | 79% | 0.64 μm | 48% | 85% | A |
| Example 13 | 6.0 μm | 82% | 0.61 μm | 52% | 92% | A |
| Example 14 | 5.9 μm | 85% | 0.64 μm | 49% | 93% | A |
| Example 15 | 6.1 μm | 78% | 0.63 μm | 51% | 95% | A |

TABLE 1-continued

| | | | | | | |
|---|---|---|---|---|---|---|
| Comparative Example 1 | 5.8 μm | 68% | 0.63 μm | 50% | 89% | D |
| Comparative Example 2 | 5.9 μm | 81% | 0.28 μm | 63% | 82% | C |
| Comparative Example 3 | 6.0 μm | 80% | 0.82 μm | 58% | 85% | D |
| Comparative Example 4 | 6.2 μm | 81% | 0.59 μm | 76% | 93% | D |
| Comparative Example 5 | 6.2 μm | 82% | 0.60 μm | 51% | 89% | C |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising: toner particles each having a core-shell structure with a core and a shell layer coated on the core, the core containing a first binder resin including a polyester resin and a styrene (meth)acrylic resin, and the shell layer containing a release agent which includes a hydrocarbon wax, wherein 70% or more of the release agent with respect to the entire release agent is present within 800 nm from the surface of the toner particles;

wherein the styrene (meth)acrylic resin forms domains having an average diameter of 0.3 μm to 0.8 μm in the toner particles; and wherein a number ratio of the domains included in a range of the average diameter±0.1 μm is less than 65%.

2. The electrostatic charge image developing toner according to claim 1, wherein the toner particles have a number ratio of the domains included in a range of the average diameter±0.2 μm of 80% or more.

3. The electrostatic charge image developing toner according to claim 1, wherein the core further includes a second release agent and the second release agent and the styrene (meth)acrylic resin are dispersed in the first binder resin.

4. The electrostatic charge image developing toner according to claim 1, wherein a ratio of the polyester resin to the first binder resin is 85% by weight or more.

5. The electrostatic charge image developing toner according to claim 1, wherein a glass transition temperature (Tg) of the polyester resin is from 50° C. to 80° C.

6. The electrostatic charge image developing toner according to claim 1, wherein a weight average molecular weight (Mw) of the polyester resin is from 5,000 to 1,000,000.

7. The electrostatic charge image developing toner according to claim 1, wherein a number average molecular weight (Mn) of the polyester resin is from 2,000 to 100,000.

8. The electrostatic charge image developing toner according to claim 1, wherein a molecular weight distribution Mw/Mn of the polyester resin is from 1.5 to 100.

9. The electrostatic charge image developing toner according to claim 1, wherein the styrene (meth)acrylic resin is a copolymer obtained by copolymerizing a monomer having a styrene structure and a monomer having a (meth) acrylic acid structure, and a copolymerization ratio of the monomer having a styrene structure and the monomer having a (meth)acrylic acid structure is from 85/15 to 70/30.

10. The electrostatic charge image developing toner according to claim 1, wherein the styrene (meth)acrylic resin has a crosslinked structure.

11. The electrostatic charge image developing toner according to claim 10, wherein a copolymerization ratio of a crosslinking monomer with respect to the entirety of monomers (crosslinking monomer/entirety of monomer based on weight) in the styrene (meth)acrylic resin is from 2/1000 to 30/1000.

12. The electrostatic charge image developing toner according to claim 1, wherein a weight average molecular weight of the styrene (meth)acrylic resin is from 30000 to 200000.

13. The electrostatic charge image developing toner according to claim 1, wherein a content of the styrene (meth)acrylic resin is from 10% by weight to 30% by weight with respect to the toner particles.

14. The electrostatic charge image developing toner according to claim 1, wherein a ratio of the release agent including a hydrocarbon wax to the entire release agent is 85% by weight or more.

15. The electrostatic charge image developing toner according to claim 1, wherein a melting temperature of the release agent including a hydrocarbon wax is from 85° C. to 110° C.

16. The electrostatic charge image developing toner according to claim 1, wherein a content of the release agent including a hydrocarbon wax is from 1% by weight to 20% by weight with respect to the entire toner particles.

17. An electrostatic charge image developer comprising the electrostatic charge image developing toner according to claim 1.

18. A toner cartridge that accommodates the electrostatic charge image developing toner according to claim 1, and is detachable from an image forming apparatus.

19. The electrostatic charge image developing toner according to claim 1, wherein the shell layer further includes a second binder resin.

20. The electrostatic charge image developing toner according to claim 19, wherein a content of the first and second binder resins with respect to the toner particles is from 40% by weight to 95% by weight.

21. The electrostatic charge image developing toner according to claim 19, wherein the release agent is dispersed in the second binder resin in the shell layer.

22. The electrostatic charge image developing toner according to claim 21, wherein the second binder resin is polyester resin.

23. The electrostatic charge image developing toner according to claim 19, wherein the core further includes a colorant.

24. The electrostatic charge image developing toner according to claim 1, wherein a surface of each shell layer forms the surface of the toner particles.

* * * * *